United States Patent [19]

Wechsler

[11] 4,300,768

[45] Nov. 17, 1981

[54] CHESS-LIKE BOARD GAMES

[76] Inventor: Allan Wechsler, 356 Somerville Ave., Somerville, Mass. 02143

[21] Appl. No.: 202,466

[22] Filed: Oct. 31, 1980

[51] Int. Cl.[3] ..... A63F 3/02

[52] U.S. Cl. ..... 273/260; 273/287

[58] Field of Search ..... 273/258, 260, 261, 287, 273/284; D21/24

[56] References Cited

U.S. PATENT DOCUMENTS

| | | | |
|---|---|---|---|
| D. 132,124 | 4/1942 | Dunlap | 273/248 X |
| 1,633,445 | 6/1927 | Gail et al. | 273/272 |
| 3,820,791 | 6/1970 | Powers | 273/284 X |
| 3,989,253 | 11/1976 | Schifman | 273/260 |

FOREIGN PATENT DOCUMENTS

| | | | |
|---|---|---|---|
| 2229202 | 12/1974 | France | 273/260 |

OTHER PUBLICATIONS

"Smess–The Ninny's Chess Game", Catalog Received 10/1973 and Found in A. U. 334 Search Room.

*Primary Examiner*—Richard C. Pinkham
*Assistant Examiner*—Scott L. Brown
*Attorney, Agent, or Firm*—Neal J. Mosely

[57] ABSTRACT

A new chess-like board game consists of a checkerboard having rows and columns of bilaterally colored dark and light squares. The squares in the respective rows and columns are an odd number, not less than five. All of the dark squares on the board bear indicators pointing in the same direction aligned with either a row or a column of the board. All of light squares on the board bear indicators pointing in the same direction aligned with a row or column of the board and being in a direction normal to the indicia on the dark squares. A set of checkers is provided for each player distinguishable by color, shape, size, texture or the like. Each set corresponds to the number of squares in a row or column. The sets are initially placed on opposite sides of the board along the row of squares closest to the respective players. The checkers are moved by the players alternately, in turn, along a row or a column in the direction of the indicator on the square from which the move is made. Checkers may be moved only for an uninterrupted distance and capture opposing checkers by occupying the square of such checker, but only if the color of the square occupied by the opposing checker is different from the color of the square from which the move started. The game ends when one player has captured all of his opponent's checkers.

3 Claims, 1 Drawing Figure

CHESS-LIKE BOARD GAMES

BACKGROUND OF THE INVENTION

1. FIELD OF THE INVENTION

This invention relates to new and useful improvements in board games and more particularly to board games using a checker board for play.

2. BRIEF DESCRIPTION OF THE PRIOR ART

Checkerboards have been known for hundreds of years. The very common games of chess and checkers are played on such boards and other games have been devised to be played on checkerboards using different types of pieces or using different rules for the play of the game. The game of chess has the disadvantage that it is too complex for many players. Checkers, on the other hand, is easy to play but has the disadvantage that it is fatalistic. In a game played between two good and equally matched checker players, with no constraints on the opening moves, the first player to move is guaranteed at least a draw. A variety of changes have been suggested for checkerboards and a variety of changes for playing pieces and for the rules of the game have been suggested for developing a greater interest in the game of checkers or of similar games.

Adams U.S. Pat. No. 480,056 discloses a checkerboard in which some, but not all, of the initial-playing squares are differentiated from the others by suitable marks, symbols or colors which require the play of the game according to special and different rules.

McLoughlin U.S. Pat. No. 665,123 discloses a checkerboard game apparatus having different divisions marked with distinguishing characteristics which direct certain features of the play of the game and having different types of playing pieces.

Olsen U.S. Pat. No. 2,585,268 discloses a checkerboard type game having tiles moveable on the surface of the board with indicators thereon for the move of playing pieces.

Healy U.S. Pat. No. 3,495,831 discloses a board game apparatus having a pegboard type construction and utilizing playing pieces having pegs which fit the holes on the board and which pieces move in a pivotal manner.

SUMMARY OF THE INVENTION

One of the objects of this invention is to provide a new and improved game utilizing a checkered playing board.

Another object of this invention is to provide a new and improved chess-like board game utilizing a special checkered playing board having playing pieces whose moves are directed by indicia on the squares on which the playing pieces are located.

Still another object of this invention is to provide a new and improved chess-like board game utilizing playing pieces which move like the rook at chess and whose direction of move is constrained by indicia on the individual squares of the playing board.

Other objects of this invention will become apparent from time to time throughout the specification and claims as hereinafter related.

A new and improved chess-like board game which meets the above stated objectives, consists of a checkerboard having an odd number of rows and columns and sufficient playing pieces or checkers for each player to be placed initially along the rows on opposite sides of the board adjacent the respective players. All of the light squares on the board bear indicators pointing in the same direction aligned either with a row or a column of the board. All of the dark squares of the board bear indicators pointing in the same direction along a row column of the board but normal to the indicia on the light squares. The players move the checkers only along a row or column in the manner of the move of the rook at chess. The pieces, however, may be moved only in the direction of the indicator on the square from which the move is started and only for an uninterrupted distance. A checker being moved may capture and displace from the board on opposing piece by occupying the square on which the opposing piece is located provided that that square is of a different color from the square from which the move was started. The game ends when one player has captured all of his opponents checkers or playing pieces.

BRIEF DESCRIPTION OF THE DRAWINGS

In the drawings, the FIGURE shown is a preferred embodiment of a playing board and including the playing pieces positioned thereon for carrying out the play of one embodiment of this invention.

DESCRIPTION OF THE PREFERRED EMBODIMENT

Figure 1:
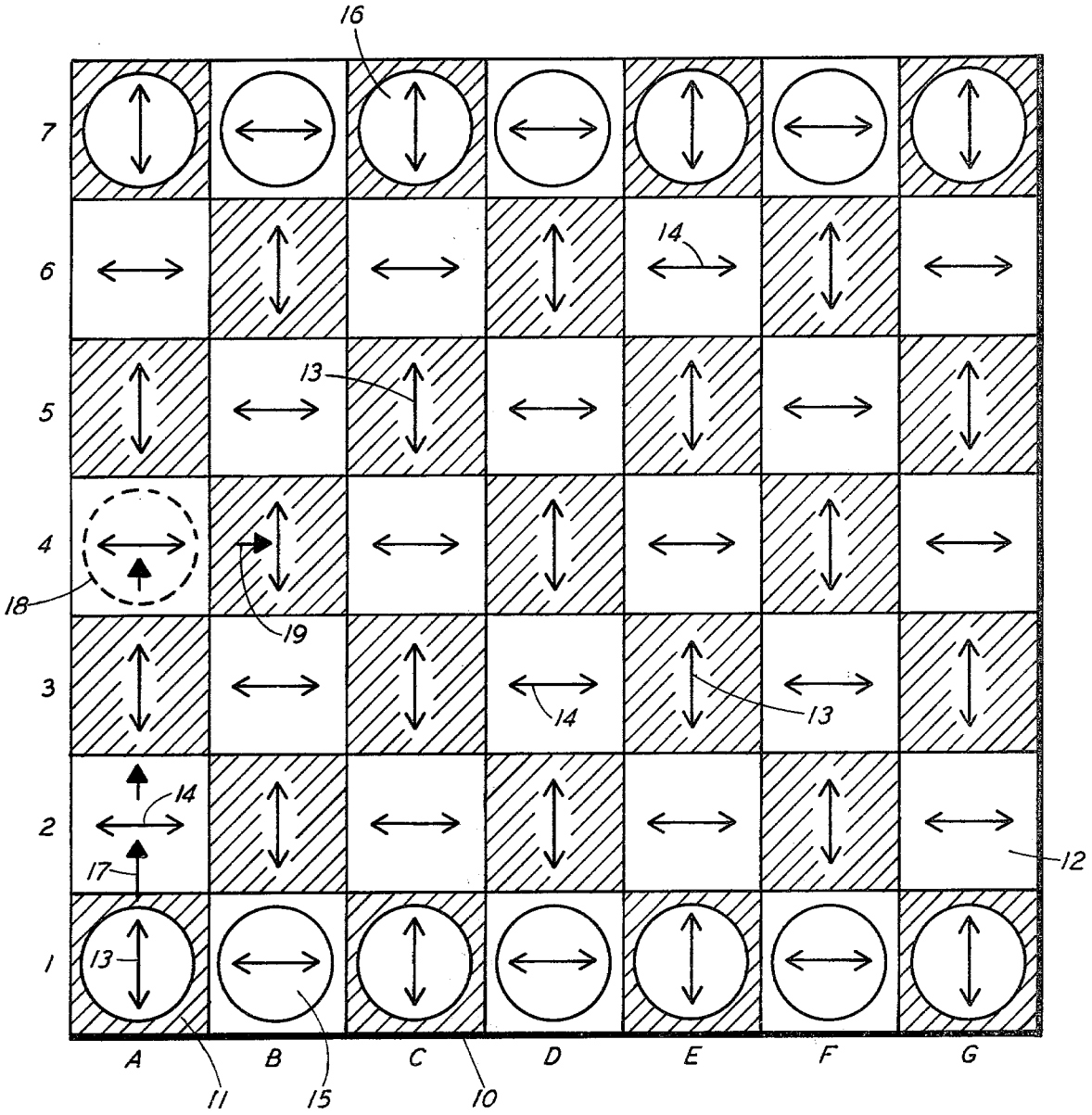

The game shown in the attached drawing has been called the game of Crook and was developed by the inventor at M.I.T. and made the subject of a computer analysis of the play of the game.

In the drawing there is shown a game board 10 which is a checkerboard having rows and columns of bilaterally colored dark and light squares. The dark squares 11 and the light squares 12 are arranged in rows and columns as on a conventional checkerboard. The number of rows and columns in each direction is the same and must be an odd number. It has been determined by experimentation that the play of the game using boards with even numbers of squares breaks down rapidly and is very uninteresting. The number of squares in each row and column, as previously noted, is odd and must be at least five squares. Games of seven and nine squares on a side are relatively easy to play. Games with eleven to fifteen squares on a side become more complex but are playable. Games with more than about fifteen squares on a side appear to be too complex to be of much interest. It is therefore preferred to use a board having from five to fifteen squares on a side, with the order seven and order nine games being preferred. The order five game is interesting but reaches a conclusion in a very short period of time.

Each of the dark squares on the board has an indicator 13 thereon which points along the column of squares in which it is located. All of the indicators 13 on the playing squares 11 are aligned in parallel and point in the same direction along the column in which they are positioned. Each of the light colored squares 12 has an indicator 14 which points along the row of squares. The various indicia 14 are aligned and parallel with each other and extend normal to the indicia 13 on the dark colored squares.

Each of the players is provided with a set of checkers 15 and 16 which are distinguishable by color or any other suitable means, such as shape, texture, size, etc. Each set of checkers provided is sufficient in number to fit the row adjacent each of the players. In other words, there are provided five checkers for an order five game, seven checkers for an order seven game, nine checkers for an order nine game, etc. The checkers start on the row adjacent to each of the respective players, as shown in the FIGURE of the drawings. For purposes of description of play of the game the columns will be labeled with letters from A to G and the rows will be numbered from 1 to 7. The move of the checkers at this game is along a row or column in the same manner as the rook at chess. The checkers can move, however, only in the direction of the indicators 13 or 14 on the squares from which the move starts. Thus, in the opening move, only checkers located in columns A, C, E, and G may be moved. The checkers may move any distance on the board which is unobstructed and may capture and remove an opposing piece by occupying the square on which it is located but only if that square is of a different color from the square from which the move was started. Thus, the checker located at A1 can not capture the opposing checker on square A7 but could capture a checker located on square A2 or A4 or A6.

In the FIGURE shown in the drawing, the checker 15 located on square A1 could be moved to square A4, as shown by directional arrows 17 and the dotted position indicated at 18 on a subsequent move this piece would be allowed to move along row 4 as indicated by direction arrow 19. Of course, this would be a ridiculous opening move to make since the move to square A4 would subject the piece to immediate capture by the opponent's checker 16 moving from square A7. In the move of the various playing pieces, the pieces may move any number of squares along a column or a row in the direction indicated by the indicator 13 or 14 on the square from which the move started. The number of squares moved, however, may only be an uninterrupted move, the checkers not being allowed to jump over an intervening checker.

The opening move of this game are somewhat limited and can be determined intuitively after a few experiences with the game. For example, the player starting from row 1 is limited to the movement of checkers 15 located on squares A, C, E, and G. For all practical purposes, he is limited to moving these checkers to rows 3 or 5 without risking immediate capture. As the checkers are moved from the positions A1, C1, E1 and G1, the checkers located at B1, D1 and F1 may be moved along row 1 to a column where they are free to move out from the base row.

The games have been found to have distinct opening, middle game, and end game positions. The opening of the game, usually from five to ten moves in duration, is usually a race to place the other player in Zugzwang (the term having the same meaning as in chess). During the opening phase, the game tree first widens, and then narrows again as pieces become locked into an immobile structure of threats and counterthreats. The middle game begins when one player is forced into Zugzwang, or narrowly evades it by making a sacrifice of initiating an exchange of pieces.

In the middle game, a series of exchanges unlocks the board. The game tree again widens as freedom of movement increases, and then narrows again as the number of pieces drops. The end game begins when there are few enough pieces on the board to allow the use of long range strategies for acquiring and capturing. End game strategies typically rely on the opponent's piece poverty to force him into a second, more deadly Zugzwang position from which there is no escape.

In the playing board shown in the drawing, an order five or an order seven game can be played. The game is shown for order seven type of play. If it were desired to play an order five game, which is much more simple, columns F and G and rows 6 and 7 would be eliminated. The order five game would preferably be played with the playing pieces positioned along column A and column E so that initial moves could be made only by the pieces on rows 2 and 4. This manner of play is necessary to avoid giving an undue advantage to the player having the opening move.

The playing board shown is one primarily for use as an order seven game and can be used for an order five game, as just described. Larger player boards having from nine up to fifteen squares on a side provide more complex games and also provide for the flexibility of playing games of a variety of different orders as the players become more proficient. For example, on an order fifteen board (with fifteen squares on each side) the players can start with an order five game and progress to an order seven or an order nine, etc. as they become more proficient. As previously noted, the game is best played with the playing pieces located along the side of the board which provides an even number of columns marked for permissible opening moves. As noted in the case of the order five game, the play of the game from the wrong direction gives an undue advantage to the player having the opening move.

While this invention has been described with special emphasis upon a single preferred embodiment, it should be understood that within the scope of the appended claims the invention may be practiced otherwise than as specifically described herein.

I claim:

1. A chess-like board game for two players comprising:

a checkerboard with rows and columns of bilaterally colored dark and light squares, said board having the same number of rows and columns in each direction, the number of rows and columns being an odd number not less than five, all of said dark colored squares bearing indicia pointing in the same direction aligned with rows or columns of the board, all of said light colored squares bearing indicia pointing in the same direction aligned with rows or columns of the board in a direction normal to the indicia on said dark colored squares, a set of checkers for each player, distinguishable visually in play, each set of checkers consisting of the same number as the number of squares in a row and being initially placed on opposite sides of the board on the row closest to the respective players, and the moves of the individual checkers being different on the dark and the light colored squares and directed by the indicia thereon.

2. A board game according to claim 1 in which the squares in each row or column consist of an odd number not less than five nor greater than fifteen.

3. A board game according to claim 1 or 2 in which the individual checkers may be moved in each turn of play any selected distance in a row or column which is unobstructed, but only in the direction of the indicator on the square from which the move is initiated, a checker captures an opposing checker and removes the same from the board by making an uninterrupted move to the square occupied by such opposing checker provided that the checkers at the start of the move occupied squares of different colors, and the game ends when one player has captured all of the other player's checkers.

* * * * *